US007588124B2

(12) United States Patent
Masuzoe

(10) Patent No.: US 7,588,124 B2
(45) Date of Patent: Sep. 15, 2009

(54) SPEED CONTROL METHOD OF ELEVATOR-PURPOSE INVERTER AND SPEED CONTROL APPARATUS THEREOF

(75) Inventor: Shuichi Masuzoe, Fukuoka (JP)

(73) Assignee: Kabushiki Kaisha Yaskawa Denki, Fukuoka (JP)

( * ) Notice: Subject to any disclaimer, the term of this patent is extended or adjusted under 35 U.S.C. 154(b) by 550 days.

(21) Appl. No.: 10/584,284

(22) PCT Filed: Dec. 16, 2004

(86) PCT No.: PCT/JP2004/018820

§ 371 (c)(1),
(2), (4) Date: Jun. 26, 2006

(87) PCT Pub. No.: WO2005/063603

PCT Pub. Date: Jul. 14, 2005

(65) Prior Publication Data

US 2007/0187186 A1 Aug. 16, 2007

(30) Foreign Application Priority Data

Dec. 26, 2003 (JP) ..... 2003-432191

(51) Int. Cl.
*B66B 1/24* (2006.01)
*B66B 1/40* (2006.01)

(52) U.S. Cl. ..... 187/284; 187/291; 187/293; 318/807; 318/799

(58) Field of Classification Search ..... 187/281, 187/284, 291–293, 295–297; 318/430, 432, 318/66, 80, 98, 798–815
See application file for complete search history.

(56) References Cited

U.S. PATENT DOCUMENTS

| | | | | | |
|---|---|---|---|---|---|
| 4,544,873 | A * | 10/1985 | Salihi et al. | ..... | 318/801 |
| 4,570,755 | A * | 2/1986 | Tsai et al. | ..... | 187/284 |
| 5,325,036 | A * | 6/1994 | Diethert et al. | ..... | 318/802 |
| 5,814,954 | A * | 9/1998 | Suzuki et al. | ..... | 318/376 |
| 6,066,928 | A * | 5/2000 | Kinoshita et al. | ..... | 318/139 |
| 6,283,252 | B1 * | 9/2001 | Lee | ..... | 187/291 |
| 6,700,347 | B1 * | 3/2004 | Sakurai et al. | ..... | 318/757 |

FOREIGN PATENT DOCUMENTS

| | | | |
|---|---|---|---|
| JP | 44-19210 | B1 | 8/1969 |
| JP | 4-303379 | A | 10/1992 |
| JP | 7-291542 | A | 11/1995 |
| JP | 11-89300 | A | 3/1999 |
| WO | WO 01/74700 | A1 | 10/2001 |

* cited by examiner

*Primary Examiner*—Walter Benson
*Assistant Examiner*—Eduardo Colon-Santana
(74) *Attorney, Agent, or Firm*—Sughrue Mion, PLLC

(57) ABSTRACT

A speed control method of an elevator-purpose comprising previously calculating an elevating distance in such a case that the elevator passenger car is decelerated from a reference frequency up to a leveling frequency in a constant deceleration speed, when the induction motor is stopped. The elevator passenger car is driven in a constant speed at an intermediate frequency so that the previously calculated distance becomes equal to an elevating distance when the elevator passenger car is decelerated at the constant deceleration speed from an arbitrary frequency up to the leveling frequency so as to adjust the elevating distance. The elevator passenger car is automatically decelerated at the constant deceleration speed up to the leveling frequency.

2 Claims, 6 Drawing Sheets

SPEED CONTROL METHOD OF ELEVATOR-PURPOSE INVERTER AND SPEED CONTROL APPARATUS THEREOF

TECHNICAL FIELD

The present invention relates to a speed control method and a speed control apparatus of an elevator-purpose induction motor which is driven by an inverter. More specifically, the present invention is directed to a deceleration control method and a deceleration control apparatus by an open loop speed control system.

RELATED ART

Very recently, there are many elevators in which while induction motors which are solid are employed as driving motors, the maintenance of which is very easy, these induction motors are driven by variable voltage variable frequency (VVVF) inverters. In such elevator driving apparatus arranged by combining these induction motors with the VVVF inverters, the below-mentioned speed control systems for these induction motors have been conducted. That is, generally speaking, in low-speed elevators, open loop control systems by voltage type inverters have been employed in order to simplify constructions thereof and reduce cost thereof, whereas in middle-speed elevators and high-speed elevators, speed feedback control systems equipped with speed detectors have been employed so as to increase leveling precision. It should be understood that an operation of "leveling" implies that when an elevator is approached to a stopping stage, a passenger car of the elevator is stopped in such a manner that this elevator passenger car can just, or correctly arrive at a floor of the stopping stage.

In the above-explained open loop speed control system, an output frequency of an inverter, and furthermore, an output voltage of this inverter are controlled in accordance with speed patterns, so that a driving operation of an elevator passenger car is accelerated, is performed at a constant speed, and is decelerated in such manners which are fitted to these speed patterns.

FIG. 1 is an apparatus structural diagram for indicating a speed control apparatus of an elevator-purpose inverter, which is commonly used in the present invention.

In FIG. 1, the speed control apparatus of an elevator-purpose inverter is arranged by an AC power supply 1, a rectifier 2, a capacitor 3, a voltage type inverter main circuit 4, an induction motor 5, a control apparatus 6, a winding machine 7, a passenger car 8, and a balance weight 9. The rectifier 2 converts an AC voltage of the AC power supply 1 to a DC voltage. The capacitor 3 smooths either a full-wave rectification voltage or a half-wave rectification voltage, which are rectified by the rectifier 2. The voltage type inverter main circuit 4 inverts the DC voltage smoothed by the capacitor 3 into an AC voltage having a predetermined frequency and a predetermined voltage. The induction motor is driven by the AC voltage produced by the voltage type inverter main circuit 4. The control apparatus controls the frequency and the voltage of the voltage type inverter main circuit 4. The winding machine 7 is rotatably driven by the induction motor 5. A passenger car 8 is hung by one end of a wire rope suspended on the winding machine 7. The balance weight 9 is hung by the other end of the wire rope. The control apparatus 6 is further equipped with a CPU (central processing unit) 10, and a PWM (pulse width modulator) generating unit 11.

The control apparatus 6 constituted by the CPU 10 as a major unit produces speed pattern which owns a predetermined acceleration speed, a predetermined deceleration speed, and also a constant speed time in response to an elevating distance so as to calculate an inverter drive frequency and an amplitude of a voltage, and obtains a PWM wave gate pulse in response to these acquired frequency and voltage. This PWM wave gate pulse is supplied to the PWM generating unit 11.

FIG. 6 shows an operation example of a conventional apparatus. FIG. 7 indicates an operation flow as to the CPU 10 of the conventional apparatus in FIG. 1. The operation flow of FIG. 7 is constituted by a step (S210) for judging as to whether or not an elevator is under drive condition; a step (S210) for judging as to whether or not a leveling frequency (Vj) is selected; a step (S230) for driving the elevator at the leveling frequency (Vj); and a step (S220) for driving the elevator at a reference frequency (Vn). The CPU 10 monitors as to whether the elevator passenger car 8 is under drive condition, or under stop condition. Normally, the elevator passenger car 8 is controlled in such a manner that the elevator passenger car 8 is driven at the reference frequency (Vn) under drive condition (S210 and S220). When the elevator passenger car 8 reaches the deceleration starting point, a signal of the leveling frequency (Vj) instruction is supplied to the CPU 10 when being reached to the deceleration starting point, and at this signal timing, the elevator passenger car 8 is decelerated at a constant deceleration speed from the reference frequency (Vn) up to the leveling frequency (Vj) (S230).

In this conventional apparatus, since the drive frequency of the elevator passenger car 8 is fixed at the reference frequency (Vn) of the elevator, when the elevator passenger car 8 reaches the deceleration starting position during operation, the reference frequency (Vn) is switched to the leveling frequency (Vj). The elevating distances (S) obtained when the elevator passenger car 8 is decelerated at a constant deceleration speed from the reference frequency (Vn) up to the leveling frequency (Vj) continuously become equal to each other, so that the precision of the floor arriving position is increased.

In accordance with this control system, the speed detector is no longer required, so that the low cost may be achieved. Also, the backup means with respect to the malfunction of the speed detecting system is not required.

Patent publication 1: JP-A-7-291542

DISCLOSURE OF THE INVENTION

Problems that the Invention is to Solve

However, in the above-described conventional control methods, when the elevator passenger car 8 is moved over a short elevating distance such as a next stage, if the elevator passenger car 8 is rapidly decelerated from the reference frequency to the leveling frequency, then there are some cases that comfortable conditions of the elevator passenger car 8 are deteriorated due to changes in gravity and vibrations.

It should be understood that as methods for improving floor arriving precision due to load variations in open loop speed control type elevator-purpose inverters with employment of speed sensors, one conventional method has been disclosed in the patent publication 1. However, this conventional method never provides technical ideas capable of improving comfortable conditions of elevator passenger cars, which are deteriorated by changes in gravity and vibrations in such a case that the elevator passenger cars are moved over short distances.

The present invention has an object to improve comfortable conditions of elevator passenger cars, which are deteriorated by changes in gravity and vibrations in such a case that the elevator passenger cars are moved over short distances such as a next floor, and also to increase floor arriving positional precision.

Means for Solving the Problems

According to a first aspect of the present invention, there is provided a speed control method of an elevator-purpose inverter in which an induction motor is controlled in an acceleration manner, a constant speed manner and a deceleration manner by an open loop control type inverter; and when an elevator passenger car reaches a deceleration starting position located at a constant distance from an arriving floor position, the elevator passenger car is decelerated in a constant deceleration speed in the deceleration control manner; the speed control method including the steps of: previously calculating an elevating distance in such a case that the elevator passenger car is decelerated from a reference frequency up to a leveling frequency in a constant deceleration speed, when the induction motor is stopped; driving the elevator passenger car in a constant speed at an intermediate frequency so that the previously calculated distance becomes equal to an elevating distance when the elevator passenger car is decelerated at the constant deceleration speed from an arbitrary frequency up to the leveling frequency so as to adjust the elevating distance; and automatically decelerating the elevator passenger car at the constant deceleration speed up to the leveling frequency.

Further, according to a second aspect of the present invention, there is provided a speed control apparatus of an elevator-purpose inverter in which an induction motor is controlled in an acceleration manner, a constant speed manner and a deceleration manner by an open loop control type inverter; and when an elevator passenger car reaches a deceleration starting position located at a constant distance from an arriving floor position, the elevator passenger car is decelerated in a constant deceleration speed in the deceleration control manner, including: speed correcting control member including; member for previously calculating an elevating distance in the case that the elevator passenger car is decelerated from a reference frequency up to a leveling frequency, when the induction motor is stopped; member for driving the elevator passenger can in a constant speed at an intermediate frequency so that the previously calculated distance becomes equal to an elevating distance when the elevator passenger car is decelerated at the constant deceleration speed from an arbitrary frequency up to the leveling frequency so as to adjust the elevating distance; and member for automatically decelerating the elevator passenger car at the constant deceleration speed up to the leveling frequency after the elevating distance has been adjusted.

In the present invention, while the elevator passenger car is driven at the arbitrary frequency (Vs), when the elevator passenger car reaches the deceleration starting position, the arbitrary frequency (Vs) is switched to the leveling frequency (Vi) instruction.

At this time, both the elevating distance measured when the elevator passenger car is driven in the constant speed at the intermediate frequency (Vo) and the elevating distance thereafter measured when the elevator passenger car is automatically decelerated at the constant deceleration speed up to the leveling frequency (Vj) are added to the elevating distance (S1) measured when the elevator passenger car is decelerated in the constant deceleration speed from the arbitrary frequency (Vs) up to the leveling frequency (Vj). As a result, the added elevating distance can be made equal to the elevating distance "S" measured when the elevator passenger car is decelerated in the constant deceleration speed from the reference frequency (Vn) up to the leveling frequency (Vj).

Advantage of the Invention

In accordance with the present invention, the elevator passenger car is driven in the constant speed at the intermediate frequency (Vo) in such a manner that the previously calculated distance (S) becomes equal to the elevating distance (S1) when the elevator passenger car is decelerated at the constant deceleration speed from the arbitrary frequency up to the leveling frequency so as to adjust the elevating distance, while the elevating distance (S) is previously calculated when the elevator passenger car is decelerated in the constant deceleration speed from the reference frequency (Vn) up to the leveling frequency (Vj) while the induction motor is stopped. Thereafter, the elevator passenger car is automatically decelerated in the constant deceleration speed up to the leveling frequency, so that the elevating distances (S) and (S1) having the same values can be obtained. With respect to the comfortable conditions of the elevator passenger car which are deteriorated by changes in gravity and vibrations which are caused by that the elevator passenger car is rapidly decelerated from the reference frequency up to the leveling frequency, the comfortable conditions of the elevator passenger car can be improved by changing into the arbitrary frequency, and since the elevator passenger car is driven at the constant speed at the intermediate frequency so as to adjust the elevating distance, the floor arriving precision can be improved.

Figure 1:
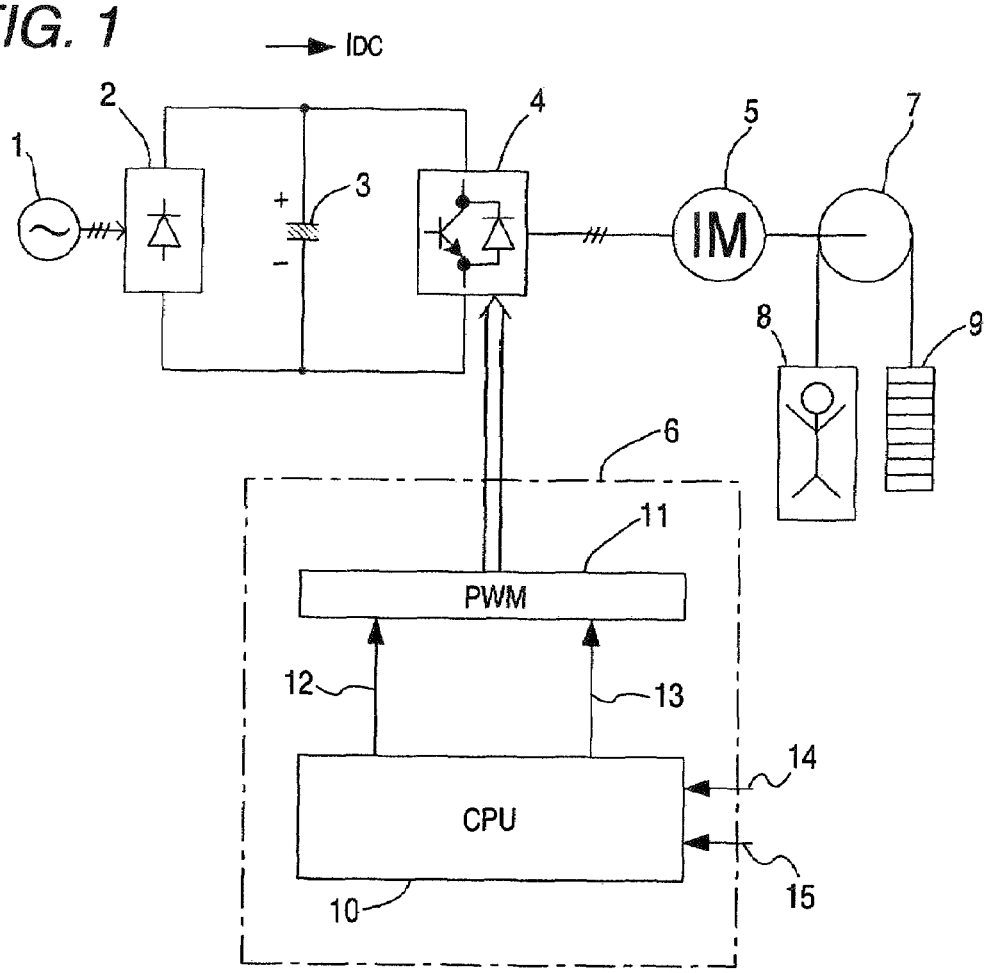
FIG. 1 is a structural diagram for indicating a speed control apparatus of an elevator-purpose inverter according to an embodiment mode of the present invention.

| Description of Reference Numerals and Signs | |
|---|---|
| 1 | AC power supply |
| 2 | rectifier |
| 3 | capacitor |
| 4 | inverter main circuit |
| 5 | induction motor |
| 6 | control apparatus |
| 7 | winding machine |
| 8 | passenger car |
| 9 | balance weight |
| 10 | CPU |
| 11 | PWM generating unit |
| 12 | frequency instruction |
| 13 | amplitude instruction |
| 14 | deceleration starting point |
| 15 | operation instruction |
| 16 | stopping condition |

-continued

| Description of Reference Numerals and Signs | |
|---|---|
| 17 | drive condition |
| 18 | in case that this function is valid |
| 19 | in case that this function is invalid |

BEST MODE FOR CARRYING OUT THE INVENTION

Referring now to drawings, a description is made of embodiment modes of the present invention.

Embodiment 1

Figure 3:
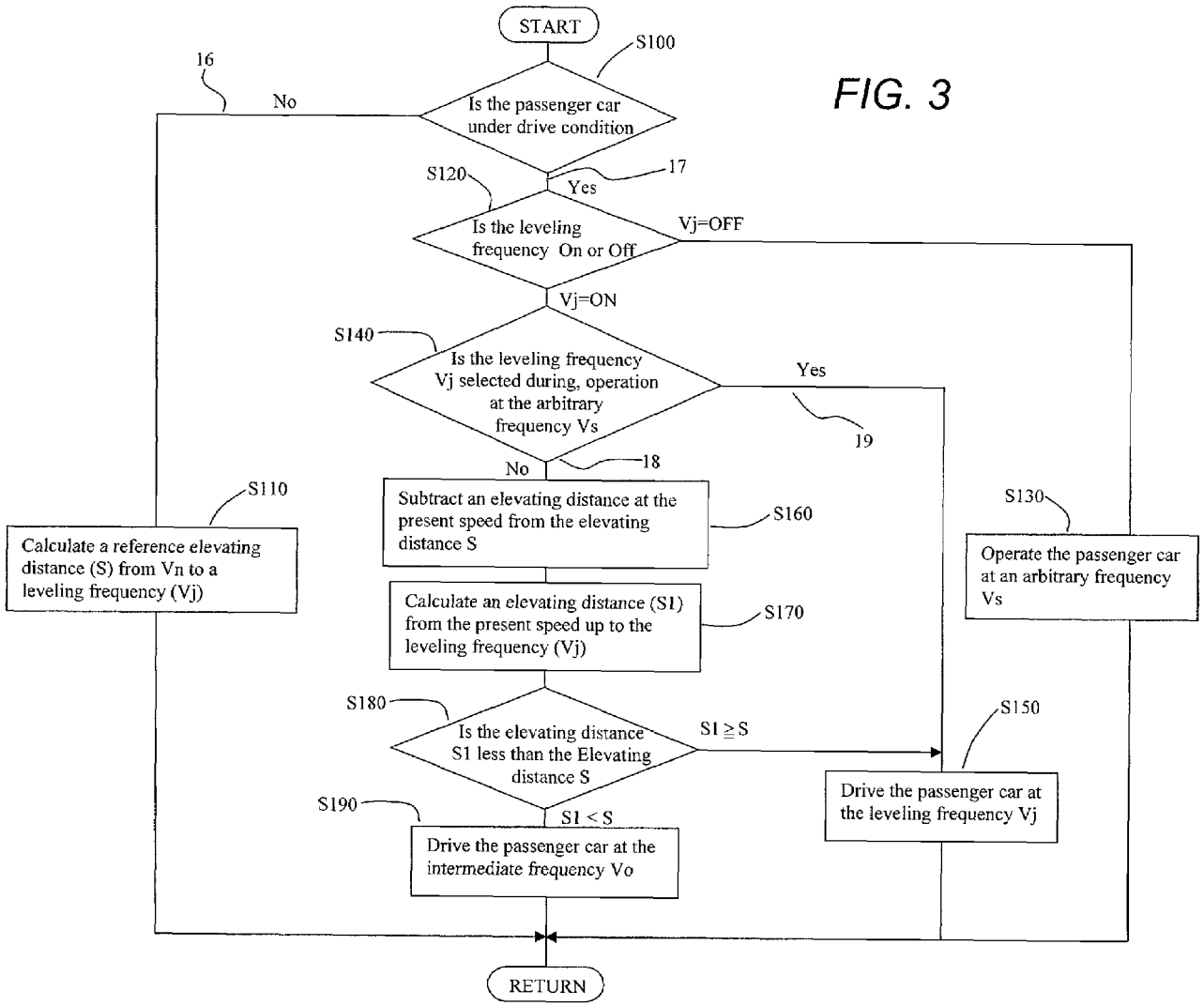
FIG. 3 is an operation flow diagram after the present embodiment mode is carried out.

FIG. 3 is a diagram of an apparatus arrangement for indicating an embodiment mode of the present invention.

In this embodiment mode, a speed control apparatus of an elevator-purpose inverter is arranged by an AC power supply 1, a rectifier 2, a capacitor 3, a voltage type inverter main circuit 4, an induction motor 5, a control apparatus 6, a winding machine 7, a passenger car 8, and a balance weight 9. The rectifier 2 converts an AC voltage of the AC power supply 1 to a DC voltage. The capacitor 3 smooths either a full-wave rectification voltage or a half-wave rectification voltage, which are rectified by the rectifier 2. The voltage type inverter main circuit 4 inverts the DC voltage smoothed by the capacitor 3 into an AC voltage having a predetermined frequency and a predetermined voltage. The induction motor is driven by the AC voltage produced by the voltage type inverter main circuit 4. The control apparatus controls the frequency and the voltage of the voltage type inverter main circuit 4. The winding machine 7 is rotatably driven by the induction motor 5. A passenger car 8 is hung by one end of a wire rope suspended on the winding machine 7. The balance weight 9 is hung by the other end of the wire rope. The control apparatus 6 is further equipped with a CPU (central processing unit) 10, and a PWM (pulse width modulator) generating unit 11.

In this embodiment mode, an AC voltage of the AC power supply is converted into a DC voltage by the rectifier 2, and the rectified DC voltage is smoothed by the capacitor 3. This DC voltage is inverted into an AC voltage whose output frequency and output voltage are controlled by the voltage type inverter main circuit 4, and then, the AC voltage is applied to the induction motor 5 corresponding to a driving motor of the elevator. The controlling operations of both an operation frequency and an operation voltage is the inverter main circuit 4 are carried out based upon a gate pulse frequency control and a pulse width control by the control apparatus 6. As a result of this control operation, the operation speed of the induction motor 5 is controlled. The induction motor 5 drives via the winding machine 5 loads of the passenger car 8 and the balance weight 9.

The control apparatus 6 constituted by the CPU 10 as a major unit produces a speed pattern which owns a predetermined acceleration speed, a predetermined deceleration speed, and also a constant speed time in response to an elevating distance so as to acquire an inverter drive frequency and an amplitude of a voltage, and obtains a PWM wave gate pulse in response to these acquired frequency and voltage. This PWM wave gate pulse is supplied to the PWM generating unit 11.

A speed correcting control member provided with the CPU 10 performs control operations in such a manner that even when a set value of an arbitrary frequency (Vs) is changed, the passenger car 8 of the elevator is operated in a constant speed at an intermediate frequency (Vo) so as to adjust an elevating distance; and thereafter, when the elevator passenger car 8 reaches the deceleration starting position, the elevator passenger car 8 is automatically decelerated in a constant deceleration speed up to the leveling frequency (Vj).

Figure 2:
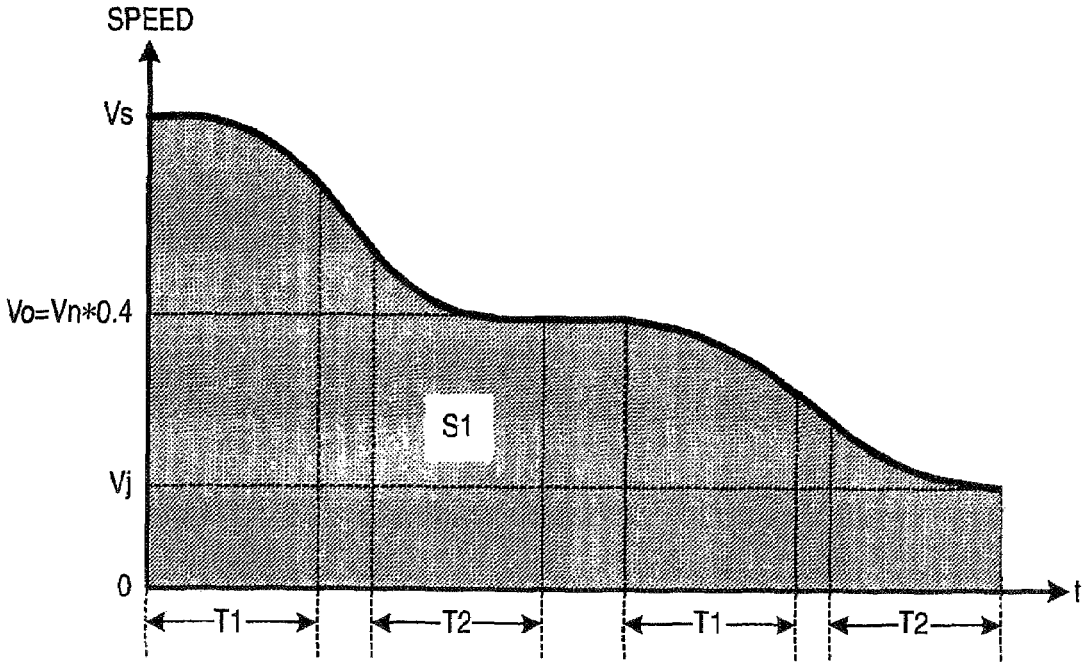
FIG. 2 is an explanatory diagram for indicating an operation example after the present embodiment mode is carried out.

FIG. 2 indicates an operation example as to the embodiment mode of the present invention. FIG. 3 shows an operation flow after the present invention is carried out. In FIG. 3, symbol S100 shows a step for judging as to whether or not the elevator passenger car is under drive condition. Symbol S110 represents a step for calculating a reference elevating distance (S) from Vn to Vj. Symbol S120 shows a step for judging as to whether the leveling frequency "Vj" is "ON", or "OFF." Symbol S130 indicates a step for operating the elevator passenger car 8 at an arbitrary frequency "Vs." Symbol S140 represents a step for judging as to whether or not the leveling frequency Vj is selected during driving operation at the arbitrary frequency Vs. In a step S140, when this function is valid (19), the elevator passenger car 8 is directly decelerated up to the leveling frequency Vj. Symbol S150 is a step for driving the elevator passenger car 8 at the leveling frequency Vj. Symbol S160 indicates a step for subtracting an elevating distance at the present speed from the elevating distance (S). Symbol S170 shows a step for calculating an elevating distance (S1) from the present speed up to Vj. Symbol S180 represents a step for comparing the magnitude of the elevating distance (S1) with the magnitude of the elevating distance (S). Symbol S190 indicates a step for operating the elevator passenger car 8 at the intermediate frequency (Vo) (operated at 40% of Vn).

The CPU 10 monitors as to whether the elevator passenger car 8 is under drive condition, or under stop condition (step S100). Normally, the elevator passenger car 8 is controlled in such a manner that the elevator passenger car 8 is driven at the arbitrary frequency (Vs) under drive condition (S120 and S130). When the elevator passenger car 8 reaches the deceleration starting point, a signal of the leveling frequency (Vj) instruction is supplied to the CPU 10 when being reached to the deceleration starting point, and at this signal timing, the elevator passenger car 8 is operated at a constant speed at the intermediate frequency (Vo) so as to adjust an elevating distance (S190), and is decelerated up to the leveling frequency (Vj) at a deceleration speed which is equal to the deceleration speed of the intermediate frequency (Vo) (S150).

An elevating distance corresponds to an area of a region (S) shown in *fig*. 6, and is previously calculated during stopping operation (S110). The elevating distance (S) from the reference frequency (Vn) up to the leveling frequency (Vj) may be calculated based upon the below-mentioned formula.

$$S = \frac{Tdec}{2\,fmax}(Vn^2 - Vj^2) + \frac{VnT1 + VjT2}{2} \qquad \text{[Formula 1]}$$

In this formula 1, symbol "Tdec": deceleration time, symbol "fmax": maximum frequency, symbol "Vn": reference frequency, symbol "Vs": arbitrary frequency, symbol "Vj": leveling frequency, symbol "T1": S-shaped characteristic time when deceleration is commenced, and symbol "T2": S-shaped characteristic time when deceleration is completed.

A method of calculating this elevating distance "S" will now be explained more concretely with reference to FIG. 4 and FIG. 5.

Figure 4:
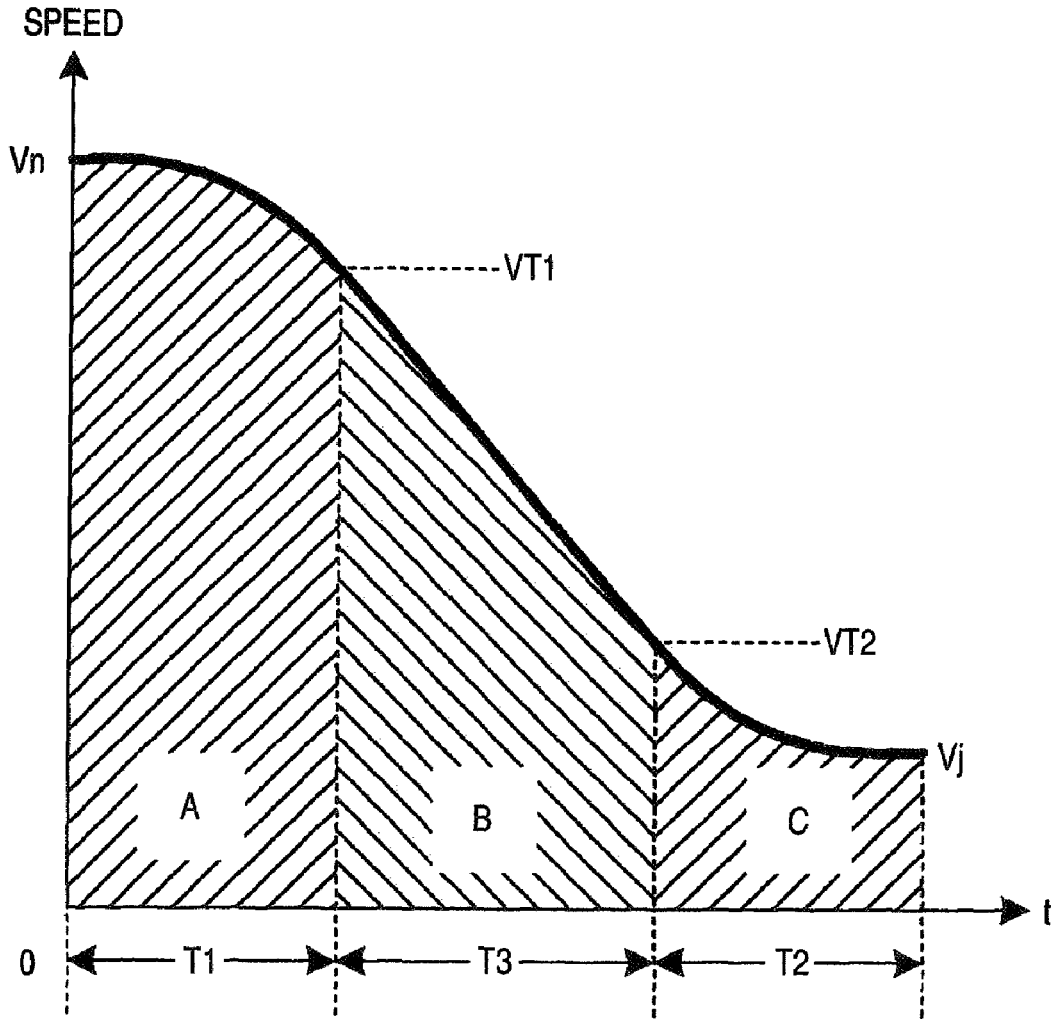
FIG. 4 is an explanatory diagram for representing a method of calculating an elevating distance.
Figure 5:
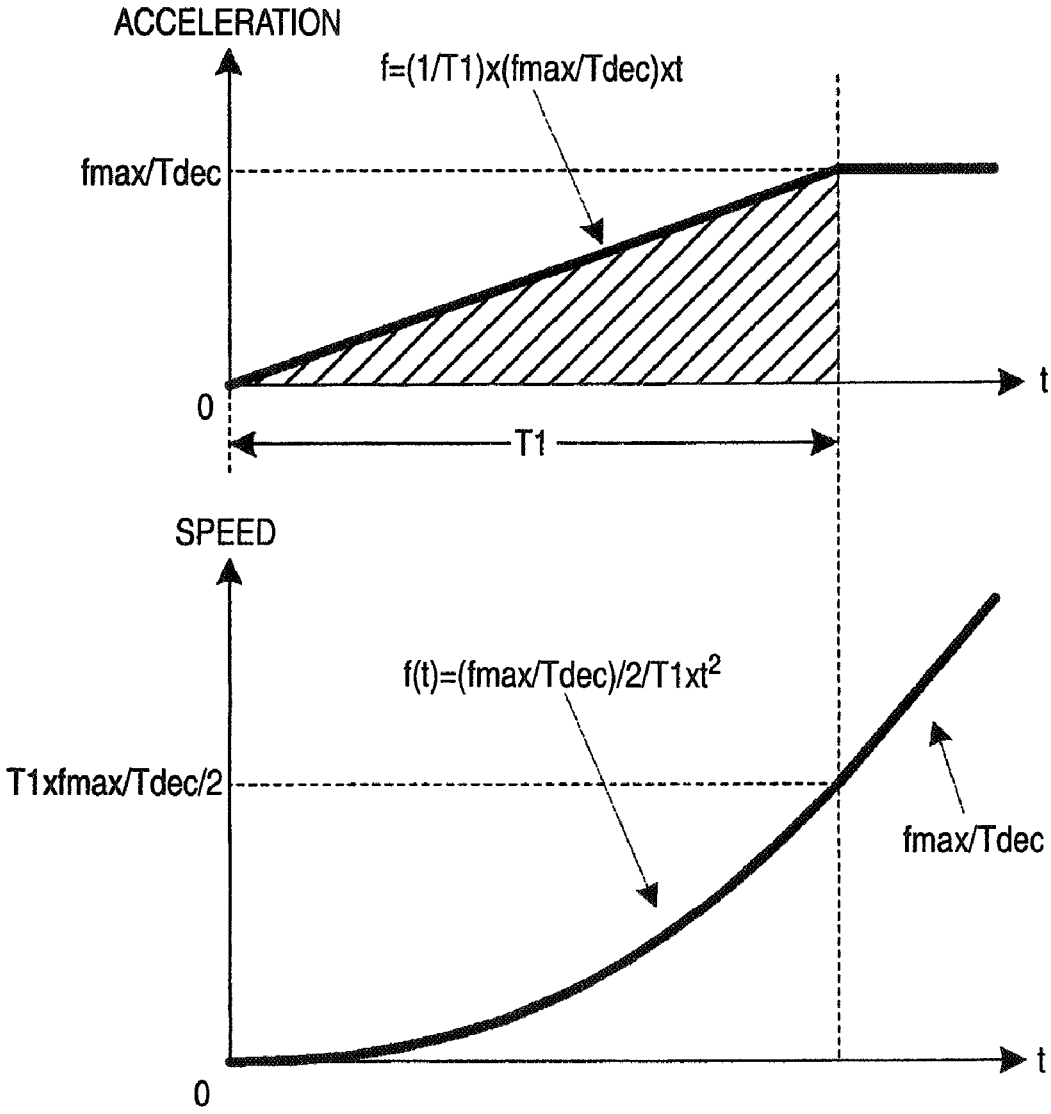
FIG. 5 is an explanatory diagram for showing a method of calculating an elevating distance of an S-shaped characteristic.
Figure 6:
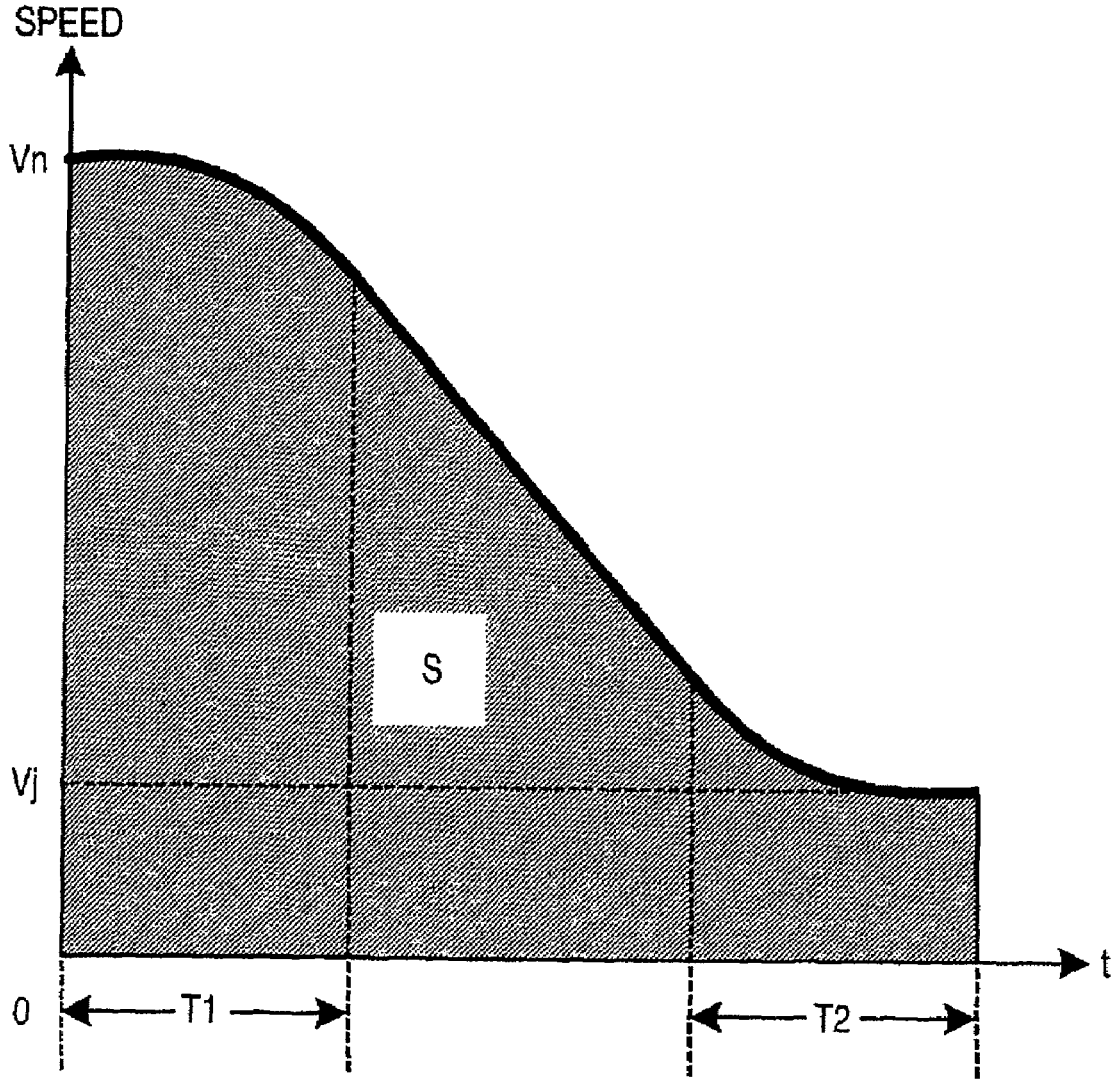
PRIOR ART FIG. 6
FIG. 6 is an explanatory diagram for explaining the operation example of the conventional apparatus.
Figure 7:
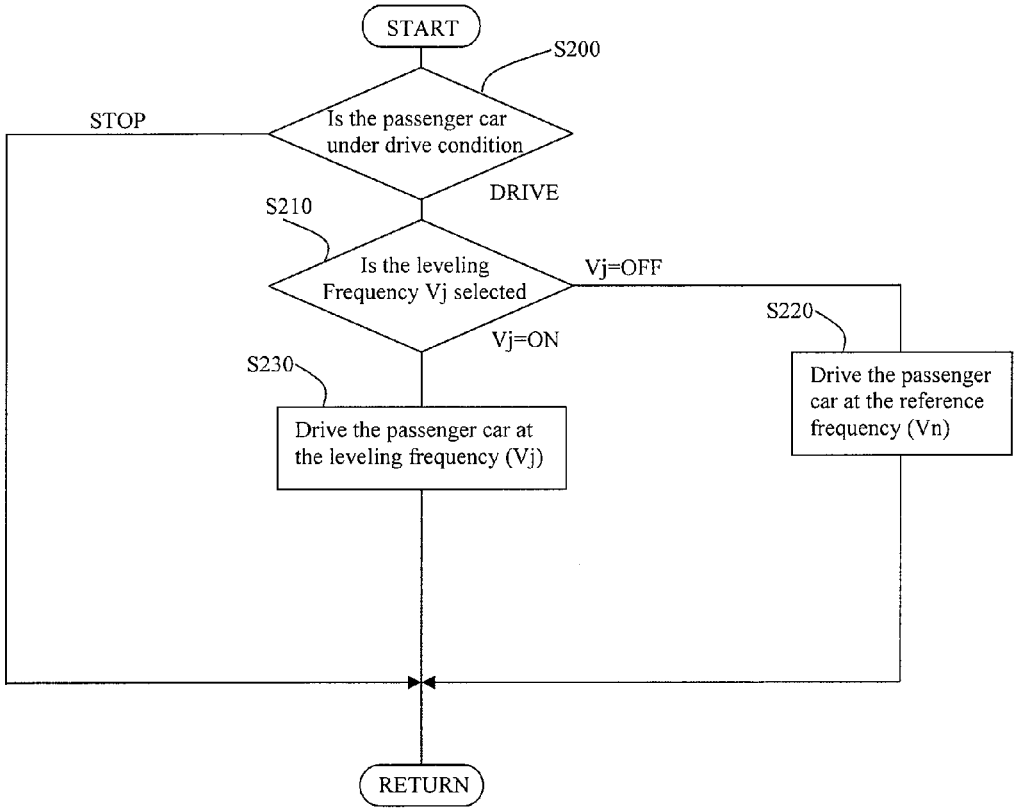
PRIOR ART FIG. 7
FIG. 7 is the operation flow diagram of the conventional apparatus.

In FIG. 4, an elevating distance until the elevator passenger car 8 is decelerated from Vn to Vj becomes an area of a meshed portion. In order to calculate this area, first of all, as indicated in FIG. 5, an S-shaped characteristic will now be considered. During the S-shaped characteristic time T1 of FIG. 5, since an increase of acceleration becomes constant, a speed "f" is expressed by the following formula.

$$f = \frac{1}{T1} \times \frac{fmax}{Tdec} \times t \quad \text{[Formula 2]}$$

As a result, a speed during the time T1 of FIG. 4 is expressed by the following formula:

$$f(t) = \int_0^t f\,dt = \int_0^t \left(\frac{1}{T1} \times \frac{fmax}{Tdec} \times t\right) dt = \frac{fmax}{2Tdec} \times \frac{t^2}{T1} \quad \text{[Formula 3]}$$

After the time T1 has elapsed, acceleration becomes constant, the speed becomes a straight line which is increased with an inclination of "fmax/Tdec", and a section T2 becomes a parabola whose direction is opposite to that of the section T1. In order to calculate these areas, an S-shaped characteristic section is considered by being resolved. A function of a section "A" is expressed by the following formula.

$$f_1(t) = Vn - \frac{fmax}{2Tdec} \times \frac{t^2}{T1} \quad \text{[Formula 4]}$$

As a consequence, an area "A" of this section "A" is given by the below-mentioned formula:

$$A = \int_0^{T1} f_1(t)dt = \int_0^{T1} Vn\,dt - \frac{fmax}{2Tdec \times T1} \int_0^{T1} t^2 dt = VnT1 - \frac{fmax}{2Tdec \times T1} \frac{T1^3}{3} = VnT1 - \frac{fmax \times T1^2}{6Tdec} \quad \text{[Formula 5]}$$

A function of a section "C" is given by the following formula:

$$f_2(t) = Vj + \frac{fmax}{2Tdec} \times \frac{t^2}{T2} \quad \text{[Formula 6]}$$

As a consequence, an area "C" of the section "C" is given by the following formula:

$$C = \int_0^{T2} f_2(t)dt = VjT2 + \frac{fmax \times T2^2}{6Tdec} \quad \text{[Formula 7]}$$

A section "B" may be obtained by calculating an area of a trapezoid, the upper bottom of which is VT2, the lower bottom of which is VT2, and the height of which is T3. Since the section "B" is changed in a leaner manner by the below-mentioned inclination:

$$-\frac{fmax}{Tdec}, \quad \text{[Formula 8]}$$

the height T3 is given by the following formula:

$$T3 = \frac{Tdec}{fmax}(VT1 - VT2) \quad \text{[Formula 9]}$$

Also, "VT1" and "VT2" are given by the following formula:

$$\begin{aligned} VT1 &= f_1(T1) \\ &= Vn - \frac{fmax}{2Tdec} \times \frac{T1^2}{T1} \\ &= Vn - \frac{fmax}{2Tdec} T1 \end{aligned} \quad \text{[Formula 10]}$$

$$\begin{aligned} VT2 &= f_2(T2) \\ &= Vj + \frac{fmax}{2Tdec} T2 \end{aligned}$$

As a result, "B" is given as follows:

$$\begin{aligned} B &= (VT1 + VT2) \times \frac{T3}{2} \quad \text{[Formula 11]} \\ &= \frac{Tdec}{2f\max}(VT1 + VT2)(VT1 - VT2) \\ &= \frac{Tdec}{2f\max}\left\{\left(Vn - \frac{f\max}{2Tdec}T1\right) + \left(Vj + \frac{f\max}{2Tdec}T2\right)\right\} \\ &\quad \left\{\left(Vn - \frac{f\max}{2Tdec}T1\right) - \left(Vj + \frac{f\max}{2Tdec}T2\right)\right\} \\ &= \frac{Tdec}{2f\max}\left\{Vn + Vj - \frac{f\max}{2Tdec}(T1 - T2)\right\} \\ &\quad \left\{Vn - Vj - \frac{f\max}{2Tdec}(T1 + T2)\right\} \\ &= \frac{Tdec}{2f\max}\left\{\begin{array}{c} Vn^2 - VnVj - \frac{Vnf\max}{2Tdec}(T1 + T2) + \\ VnVj - Vj^2 - \frac{Vjf\max}{2Tdec}(T1 + T2) - \\ \frac{Vnf\max}{2Tdec}(T1 - T2) + \frac{Vjf\max}{2Tdec}(T1 - T2) + \\ \frac{f\max^2}{4Tdec^2}(T1 + T2)(T1 - T2) \end{array}\right\} \\ &= \frac{Tdec}{2f\max}(Vn^2 - Vj^2) - \frac{Vn}{4}(T1 + T2) - \frac{Vj}{4}(T1 + T2) - \\ &\quad \frac{Vj}{4}(T1 - T2) + \frac{Vj}{4}(T1 - T2) + \frac{f\max}{8Tdec}(T1^2 - T2^2) \\ &= \frac{Tdec}{2f\max}(Vn^2 - Vj^2) - \frac{VnT1 + VjT2}{2} + \\ &\quad \frac{f\max}{8Tdec}(T1^2 - T2^2) \end{aligned}$$

Since S=A+B+C, the elevating distance "S" is given as follows:

$$\begin{aligned} S &= A + B + C \\ &= VnT1 - \frac{f\max}{6Tdec}T1^2 + \frac{Tdec}{2f\max}(Vn^2 - Vj^2) - \frac{VnT1 + VjT2}{2} + \\ &\quad \frac{f\max}{8Tdec}(T1^2 - T2^2) + VjT2 + \frac{f\max}{6Tdec}T2^2 \\ &= \frac{Tdec}{2f\max}(Vn^2 - Vj^2) + \frac{2(VnT1 + VjT2)}{2} - \frac{VnT1 + VjT2}{2} - \\ &\quad \frac{f\max}{6Tdec}(T1^2 - T2^2) + \frac{f\max}{8Tdec}(T1^2 - T2^2) \\ &= \frac{Tdec}{2f\max}(Vn^2 - Vj^2) + \frac{VnT1 + VjT2}{2} - \frac{f_{\max}}{24Tdec}(T1^2 - T2^2) \end{aligned}$$

In this formula, assuming now that T1 is nearly equal to T2, the below-mentioned formula 13 can be neglected:

$$\frac{f\max}{24Tdec}(T1^2 - T2^2) \qquad \text{[Formula 13]}$$

Based upon the above-explained conditions, an elevating distance "S" when the elevator passenger car 8 is decelerated with an S-shaped characteristic from Vn to Vj is given by the following formula (step S110):

$$S = \frac{Tdec}{2f\max}(Vn^2 - Vj^2) + \frac{VnT1 + VjT2}{2} \qquad \text{[Formula 14]}$$

Also, as to an area of the region (S1) shown in FIG. 2, an elevating distance (S1) from the arbitrary frequency (Vs) up to the leveling frequency (Vi) may be calculated by the following formula (step S170):

$$S1 = \frac{Tdec}{2f\max}(Vs^2 - Vj^2) + \frac{VsT1 + VjT2}{2} \qquad \text{[Formula 15]}$$

In the case that an elevating distance is S1<S (S180), the elevator passenger car 8 is driven in Vo (S190). In a next scan, a distance over which the elevator passenger car 8 is advanced at the present speed (intermediate frequency Vo) is subtracted from the elevating distance "S" which is calculated during stopping operation (S160).

$$S=S-VoTs \qquad \text{[Formula 16]}$$

(symbol "Ts" indicates sampling time).

After the driving operation of the elevator passenger car 8 waits at the intermediate frequency Vo until the elevating distance "S1" becomes equal to "S", the elevator passenger car 8 is decelerated up to the leveling frequency (Vj), so that the elevating distances "S" and "S1" can be made equal to each other.

In other words, the equal condition between the elevating distances "S" and "S1" can be realized by automatically switching the frequency instructions based upon the time "t" in such a manner that the below-mentioned formula can be satisfied:

$$S=S1+\Sigma Vo\cdot t \qquad \text{[Formula 17]}$$

In the embodiment mode of the present invention, the operation time at the intermediate frequency (Vo) is adjusted in such a manner that the elevating distance from Vs up to Vj may become equal to the reference elevating distance "S."

In other words, while the elevator passenger car 8 is driven at the arbitrary frequency Vs (<Vn) in the step S130, when the leveling frequency Vj is selected in the step S140, the elevator passenger car 8 is once decelerated up to 40% (Vo) of the reference frequency Vn in the step S190. After the drive operation of the elevator passenger car 8 waits until such a time that the elevating distance until the frequency reaches the leveling frequency Vj becomes "S" in the step S180, the elevator passenger car 8 is decelerated up to the leveling frequency Vj in the step S150.

While the elevator passenger car 8 is driven at the lower speed than 40% of the reference frequency Vn, when the leveling frequency Vj is selected, after the driving operation waits until such a time that the elevating distance at this speed until the frequency reaches the leveling frequency Vj becomes "S", the elevator passenger car 8 is decelerated up to the leveling frequency Vj.

While the driving operation of the elevator passenger car 8 is accelerated, when the leveling frequency Vj is selected, operations are different from each other in response to frequency instructions issued at this time.

When the frequency instruction>(40% of Vn), after the drive operation of the elevator passenger car 8 waits until such a time that the elevating distance until the frequency reaches the leveling frequency Vj at 40% of the reference frequency Vn becomes "S", the elevator passenger car 8 is decelerated up to the leveling frequency Vj. When the frequency instruction<(40% of Vn), after the drive operation of the elevator passenger car 8 waits until such a time that the moving time until the frequency reaches the leveling frequency Vj at this frequency becomes "S", the elevator passenger car 8 is decelerated up to the leveling frequency Vj.

Thus, the elevating distances "S" and "S1" can be obtained equal to each other in the above-explained manner. In the case that the elevator passenger car is moved over the short distances such as a next floor, since the frequency is changed into the arbitrary frequency, the comfortable conditions of the passenger car can be improved, which are deteriorated by the changes in gravity and the vibrations. The elevator passenger car is driven in the constant speed at the intermediate frequency so as to adjust the elevating distance. As a result, such a problem that the floor arriving position is largely deviated can be solved.

INDUSTRIAL APPLICABILITY

The present invention can be utilized in speed control operations as to the inverter drive type elevator-purpose induction motor capable of improving the comfortable conditions of the elevator passenger car, which are deteriorated by the changes in gravity and the vibrations since the elevator passenger car is rapidly decelerated, and also capable of improving the floor arriving precision.

The invention claimed is:

1. A speed control method of an elevator-purpose inverter in which an induction motor is controlled in an acceleration manner, a constant speed manner and a deceleration manner by an open loop control type inverter; and when an elevator passenger car reaches a deceleration starting position located at a constant distance from an arriving floor position, the elevator passenger car is decelerated in a constant deceleration speed in the deceleration control manner, the speed control method comprising the steps of:

previously calculating an elevating distance when the elevator passenger car is decelerated from a reference frequency up to a leveling frequency in a constant deceleration speed, when the induction motor is stopped;

driving the elevator passenger car in a constant speed at an intermediate frequency so that the previously calculated distance becomes equal to an elevating distance when the elevator passenger car is decelerated at the constant deceleration speed from an arbitrary frequency up to the leveling frequency so as to adjust the elevating distance; and automatically decelerating the elevator passenger car at the constant deceleration speed up to the leveling frequency.

2. A speed control apparatus of an elevator-purpose inverter in which an induction motor is controlled in an acceleration manner, a constant speed manner and a deceleration manner by an open loop control type inverter; and when an elevator passenger car reaches a deceleration starting position located at a constant distance from an arriving floor position, the elevator passenger car is decelerated in a constant deceleration speed in the deceleration control manner, comprising:

speed correcting control member including;

member for previously calculating an elevating distance when the elevator passenger car is decelerated from a reference frequency up to a leveling frequency, when the induction motor is stopped;

member for driving the elevator passenger can in a constant speed at an intermediate frequency so that the previously calculated distance becomes equal to an elevating distance when the elevator passenger car is decelerated at the constant deceleration speed from an arbitrary frequency up to the leveling frequency so as to adjust the elevating distance; and member for automatically decelerating the elevator passenger car at the constant deceleration speed up to the leveling frequency after the elevating distance has been adjusted.

* * * * *